United States Patent [19]

Demo, Jr.

[11] 3,963,532

[45] June 15, 1976

[54] Fe, Cr FERRITIC ALLOYS CONTAINING Al AND Nb

[75] Inventor: Joseph J. Demo, Jr., Wilmington, Del.

[73] Assignee: E. I. Du Pont de Nemours and Company, Wilmington, Del.

[22] Filed: May 30, 1974

[21] Appl. No.: 474,541

[52] U.S. Cl. ..... 148/37; 75/124; 75/126 C; 75/126 F; 75/126 J

[51] Int. Cl.[2] ..... C22C 38/06; C22C 38/26

[58] Field of Search ..... 75/124, 126 F, 126 J, 75/126 C; 148/37

[56] References Cited

UNITED STATES PATENTS

| | | | |
|---|---|---|---|
| 1,508,032 | 9/1929 | Smith | 75/124 |
| 2,080,001 | 5/1937 | Becket et al. | 75/126 F |
| 2,274,999 | 3/1942 | Allen | 75/126 C |
| 3,455,681 | 7/1969 | Moskowitz et al. | 75/126 D X |
| 3,672,876 | 6/1972 | Sipos et al. | 75/124 |
| 3,807,991 | 4/1974 | Gregory et al. | 78/126 F |
| 3,813,240 | 5/1974 | Abe | 75/124 X |
| 3,834,897 | 9/1974 | Nevalainen | 75/124 |
| 3,865,644 | 2/1975 | Hellner | 75/124 X |

*Primary Examiner*—Arthur J. Steiner

[57] ABSTRACT

Ferritic iron-chromium alloys containing 25–28 wt. per cent chromium inhibited against the embrittling effects of C+N up to a combined total of about 0.18 weight per cent by inclusion of Nb together with Al.

4 Claims, 1 Drawing Figure

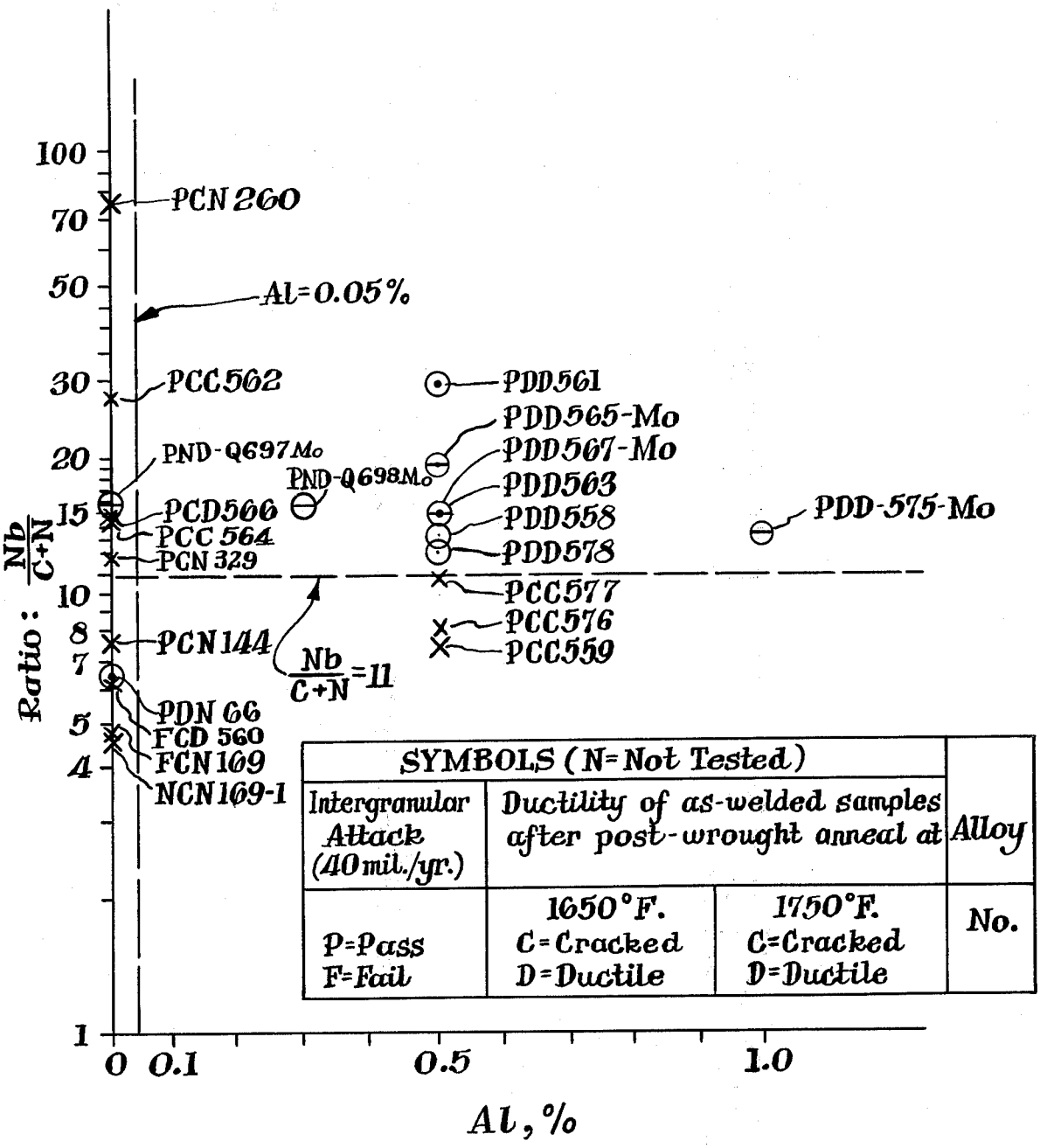
Ratio: Nb/(C+N)
100
70
50
30
20
15
10
8
7
5
4
1
PCN 260
Al=0.05%
PCC562
PND-Q697Mo
PND-Q698Mo
PCD566
PCC 564
PCN 329
PCN144
PDN 66
FCD 560
FCN 169
NCN169-1
PDD561
PDD565-Mo
PDD567-Mo
PDD563
PDD558
PDD578
PCC577
PCC576
PCC559
PDD-575-Mo
Nb/(C+N)=11
0
0.1
0.5
1.0
Al, %
SYMBOLS (N=Not Tested)
Intergranular Attack (40 mil./yr.)
Ductility of as-welded samples after post-wrought anneal at
Alloy
P=Pass
F=Fail
1650°F.
C=Cracked
D=Ductile
1750°F.
C=Cracked
D=Ductile
No.

FE, CR FERRITIC ALLOYS CONTAINING AL AND NB

CROSS REFERENCE TO RELATED APPLICATIONS

The subject matter of this application is related to those of U.S. Pat. No. 3,672,876, and application Ser. No. 122,529 filed Mar. 9, 1971, and U.S. Pat. No. 371,951 filed June 21, 1973, all of common assignment.

BRIEF SUMMARY OF THE INVENTION

Generally, this invention is a corrosion-resistant ferritic alloy having good as-welded ductility consisting essentially of 25–28 weight per cent of chromium, aluminum 0.05–0.1 weight per cent, carbon plus nitrogen 0.18 weight per cent maximum, niobium 2.0 weight per cent maximum, but at least 11 times the carbon plus nitrogen content, molybdenum 0–1.5 weight per cent, with the balance iron and incidental impurities.

DRAWING

The single FIGURE constituting part of this specification is a semi-log plot of aluminum content as abscissa versus the ratio of Nb/C+N as ordinate, in which alloys made according to this invention have compositions with aluminum contents of 0.05 weight per cent and higher, and Nb/C+N ratios of 11 and higher.

BACKGROUND

For many years there has been a preference for nickel-containing austenitic stainless steel despite the high cost of the nickel content of these alloys. Alloys of the ferritic type, while potentially less expensive because of the complete, or nearly complete, absence of nickel therefrom, have the great disadvantage of being brittle, particularly after having bee welded and not subsequently annealed.

While there has been some progress in the improvement of the impact resistance of ferritic chromium alloys, thre has been no improvement in the ductility of ferritic chromium alloys in the as-welded condition until the inventions made by applicant and his co-workers, who filed the related applications referred to supra.

Applicant and his co-workers discovered that, if certain measures were taken to control the effects of carbon and nitrogen (C and N) in their ferritic chromium alloys, novel alloys could be made which remain ductile directly after welding, without requiring intervening annealing. These workers also discovered that their novel alloys possessed high resistance to intergranular attack, which is a serious problem in many chemical plant exposures. Moreover, the alloys also possess resistance to stress corrosion cracking, which can be important not only in chemical exposures but also as regards seawater. In addition, certain of the alloys to which molybdenum was added possessed resistance to pitting corrosion, which is another serious problem frequently encountered.

Now the present applicant has discovered yet another novel grouping of constituents by the use of which, in certain specific ranges, the properties of ductility in the as-welded condition, resistance to intergranular attack, general corrosion resistance commonly associated with the presence of molybdenum, resistance to stress corrosion cracking and other desirable properties can be attained, while yet eliminating certain undesirable properties of some of the earlier alloys and, at the same time, utilizing practical raw materials and recycled scrap under practical metallurgical operating conditions.

Application Ser. No. 371,951 discloses and claims an alloy using titanium and aluminum as additives to control and overcome the effects of the C+N contents of the alloys, and, for many uses, such alloys are highly suitable. However, for some applications, where highly polished surfaces are necessary, there may be some difficulty with surface specks resulting from the presence of titanium in the alloy. The invention of the present application cures this difficulty by substituting niobium for the titanium, thereby eliminating speck appearance on the surfaces. In addition, $HNO_3$ attack on the weld metal of 26% Cr, 1% Mo + Ti alloy is high, but not if Nb is used instead of titanium.

British Patent No. 1,209,118 issued Oct. 21, 1970 to Seikosha (corresponding to Japanese patent application No. 42-36434 published 3/24/1972) discloses a ferritic chromium alloy for use in antimagnetic watch cases where high magnetic shielding together with corrosion resistance to ordinary atmospheric exposure accompanied by contact of the metal watch case with the human skin is essential. Although the Patent claims Cr from 16 to 25%, and Mo from 1 to 4%, the simple example reported was much more limited, consisting of Cr 19.2%, Mo 2%, C 0.03%, Nb 0.31%, with no reference made to aluminum or nitrogen contents, the only other materials specified besides the iron balance being silicon and manganese. In testing for corrosion resistance, the Patent states merely that "a very large number of different corrosion fluids" were used, one being a 10% hydrochloric acid solution in which the alloy of the Patent was reported to be merely discolored whereas 18-8 stainless steel, in comparison, exhibited slight corrosion.

U.S. Pat. No. 3,499,802 issued to Lagneborg discloses the use of niobium and aluminum among many combinations. In alloys containing 15 to 17.5% chromium, the aluminum is used to prevent the embrittlement of steel if held at 475°C. and is used in the quantity of 0.5 to 4% by weight. It is stated that the niobium may be used to bind C+N as carbides and nitrides, the maximum niobium content being 1%. Molybdenum also may be used for the improvement of high temperature strength up to the quantity of 3 to 4% maximum. Although there are some examples given in the Patent containing more than 17.7% chromium, none of these examples show the inclusion of niobium or molybdenum. There is no reference to welding, to corrosion resistance after such welding, nor to the brittleness of welded materials.

U.S. Pat. No. 1,954,344 issued to Becket and Franks in 1934 is an early disclosure of the use of niobium in ferritic chromium alloys to "fix" the carbon present. There is no reference to the nitrogen content of the alloys. The amount of niobium specified to fix the carbon would, if the normal commercial quantities of nitrogen of alloys of the 1934 period were present, amount to perhaps about six times the combined carbon and nitrogen content. Only two of the examples reported in this Patent contain more than 20% chromium. These two have 22.5 and 22.85%, respectively. Only the latter had niobium added, this alloy containing 0.12% carbon but no specified nitrogen content. No aluminum was added and no references are made to the alloy properties if it were welded.

U.S. Pat. No. 2,183,715 issued to Russell Franks in 1939 discloses an improvement in the corrosion resistance, particularly pitting corrosion, through the inclusion of both niobium and molybdenum in ferritic chromium alloys. An example is given at 26% chromium, 0.10% carbon, 1.05% Cb (now called niobium, Nb), and 4.16% molybdenum, which, in the reported testing procedure in ferric chloride, showed freedom from pitting. No nitrogen content is given for this alloy but, if within the usual commercial range available at the time of the Patent, the niobium content would be perhaps only about 5 times the C+N content. The Patent specified, however, that nitrogen could be added, up to the extent of 0.5%, to improve the ductility and toughness, thereby teaching away from the findings of the present applicant. The Patent further states that aluminum addition would be permissible, but gives no examples and specifies no improvement in properties from such addition. There is no information concerning product properties after welding.

Franks' U.S. Pat. No. 2,190,790 (1940), in disclosing an oxidation resistant chromium steel, taught the desirability of increasing the nitrogen content of his alloys. Thus, Franks, too, teaches away from the findings of the present applicants.

German Patent Application No. 2,148,421, applied for on 9/28/71 and laid open to inspection on 4/27/72, convention date 10/23/70, describes the use of niobium as a carbon and nitrogen fixer in ferritic stainless steel containing 13–24% Cr, 1–3% Mo and niobium 24 times the carbon content. This steel is described as corrosion resistant and ductile after welding; however, there is a stated preference for heat treatment of as-welded articles after welding to restore plasticity. There are no examples of samples containing niobium, no reference to the use of aluminum or nitrogen, nor any limitations on either.

The present applicant, in application Ser. No. 153,259, filed June 15, 1971, disclosed ferritic alloys with chromium contents in the range of 19 to 35%, with titanium and aluminum together added to offset the effect of the C+N content, which latter are causative agents for brittleness and lack of resistance to intergranular attack after the alloys have been welded. Applicant has now done additional research and has found that, within a relatively restricted range of compositions of the several variables involved, it is practicable to substitute niobium for titanium.

Therefore, this invention relates to ferritic alloys containing niobium together with aluminum (and, optionally, molybdenum) which, within certain restricted ranges of C+N and chromium possess, in the as-welded condition, overall resistance to intergranular attack, stress corrosion cracking and exposure to various media promoting pitting attack as well as nitric acid, while simultaneously possessing ductility in the as-welded condition.

Summary Statement of the Invention

Generally, this invention consists essentially of ferritic alloys containing, by weight, 25 to 28% Cr, 0 to 1.5% Mo, up to 2% Nb, 0.05 to 1.0% Al, and up to 0.18% (1800 ppm) C+N total, with the further restriction that the niobium content be at least 11 times the total C+N content, the balance of the compositions being iron and incidental impurities. "Incidental impurities", as the term is used herein, is intended to comprise those quantities of phosphorus, sulfur, copper and nickel normally found in recycle metal scrap, as well as silicon and manganese employed as deoxidizers during the melting process. It will be understood that the incidental impurities are limited in amount to the usual quantities, so as not to exert any marked effect on the desirable properties of the alloys of this invention.

The single FIGURE of drawings illustrative of this invention depicts graphically the interrelationship between the alloys' aluminum contents and the ratios of niobium content to the total C+N.

DETAILED DESCRIPTION

Twenty-two alloy specimens were prepared, many in duplicate, distributed throughout the compositional region so as to establish critical limits accurately. The samples were prepared from pure materials and cast into ingot form. The cast ingots were rolled into test samples, heat treated, welded and thereafter tested for bend ductility and for intergranular corrosion resistance all as hereinafter described.

Alloy Preparation and Testing

1. The Charge

The alloys were made from high-purity materials, as follows:

Iron — Plast-Iron Grade A101 (manufactured by the Glidden Company), a typical analysis for which is: C 16 ppm, N 43 ppm, Mn 0.002 wt. %, Si 0.005 wt. %, S 0.004 wt. % and P 0.005 wt. %.

Chromium — HP (High Purity Grade) flakes: C 16 ppm, N 7 ppm.

Aluminum — 99.8% pure, 6 mesh size, manufactured by Baker-Adamson Company.

Niobium — 99.8% pure, -325 mesh size, manufactured by Materials for Industry, Incorporated.

High C Ferrochrome — commercial material containing about 9% C.

High N Ferrochrome — commercial material containing about 6% N.

Precise C+N additions were conveniently made by using the high-carbon and high-nitrogen ferrochromes or, alternatively, by high purity graphite and $Cr_2N$ additions.

2. Melting and Processing

The alloying ingredients were melted in high purity alumina crucibles in a vacuum induction furnace, which was sealed and evacuated to $10^{-3}$ to $10^{-5}$ Torr before the power was switched on. The power was increased gradually to minimize thermal shock and, when melting was incipient, the furnace was filled with gettered argon (a purified commercial grade of argon especially low in oxygen and nitrogen content) to a vacuum of about 5 inches Hg (corresponding to an absolute pressure of about 12.3 lbs./in.$^2$) in order to inhibit vaporization of the alloying ingredients.

At the completion of the melting operation, the heat was cast through a fire brick funnel into a vertically disposed cylindrical copper mold placed in the argon atmosphere. After cooling, the ingot was removed, the hot top containing the shrinkage cavity was cut off, and the sound ingots (except specimens Q697 and Q698) were coated with "Metlseal A249", a protective coating marketed by Foseco, Inc., Cleveland, O. and soaked for 3 hrs. at 2200°F. (1204° Celsius) in an electric furnace (air atmosphere). Then the hot ingots, which were all of 1000 gm. size except as hereinafter reported, were hammer-forged at temperature to 1 in. thickness to give slabs measuring about 2½ inches ×

2½ inches (6.4 cm × 6.4 cm). Each slab at 2200°F. (1204°C) was then hot rolled in one direction in air to 5 inches length (12.2 cm), then cross rolled in the other direction to give a "hot band" piece with dimensions approximately 5 inches × 5 inches × 0.22 inch (12.2 cm × 12.2 cm × 0.56 cm). The hot band was annealed 60 mins. at 1650°F (900°C), followed by a water quench. A small piece of this annealed hot band was cold rolled. If no cracking was observed, or twinning heard, the remaining large piece of annealed hot band was cold rolled to sheets about 5 inches (12.2 cm) wide by 12 inches (30.5 cm) long × 0.1 inch (0.25 cm) thick. When the small test pieces of the annealed hot band cracked during cold rolling, the larger pieces were reheated to 2200°F (1204°C) and hot rolled to a thickness of 0.095–0.10 inch (0.24–0.25 cm). Following the hot or cold rolling process, the sheets were annealed as hereinafter reported.

Specimens Q697 and Q698, each 500 gm. size, were processed substantially as described for the specimens hereinbefore described, except that the rolled pieces were approximately one half the length and width dimensions (thickness the same) as hereinbefore reported, since these specimens were only half the weights of the majority of the specimens.

Other samples, also 500 gm. size (No. 66, 144, 169, 260, 329), were arc melted in a Heraeus furnace utilizing a "skull" melting technique employing a water-cooled copper crucible with heating accomplished under reduced helium pressure by an arc maintained between the charge and a nonconsuming tungsten electrode disposed near the top center of the charge, so that the melt was effectively insulated against pickup of metal from the crucible walls. The buttons from the arc melting step are individually hot-rolled at about 2200°F (1204°C) to a thickness of about 100 mils, after which the resulting sheets were annealed for 30 minutes and water quenched.

For some of the samples, as indicated in the Table, the anneal consisted of holding the samples for 30 mins. at 1650°F (900°C) followed by water quenching. For all other samples, the holding temperature was for 2 hrs. at 1750°F (955°C). For some compositions certain of the samples were given one of these anneals while other samples of the same composition were given the other.

3. Welding

Samples were clamped in a hold-down jig which provided inert gas circulation to the bottom side of the weld. The welding torch was held in a clamp attached to a power driven carriage which controlled the welding speed. For each pass the current, voltage and welding speeds were all recorded.

The samples were tungsten-inert gas welded using a 3/32 inch (0.24 cm) pointed thoriated tungsten tip, a ⅝ inch (1.6 cm) gas cup and argon purge gas to protect the top and bottom sides of the weld. For most samples, the cold rolled and annealed 0.1 inch (0.25 cm) sheet stock was clamped in the hold-down jig and a 9 inches to 12 inches (23 to 30.5 cm) long weld bead laid down. The sample was then indexed progressively until 3 or 4 equally spaced parallel longitudinal weld beads were laid down. After welding, the weld beads were labeled appropriately and the sample cut into separate strips measuring approximately 1 inch × 3 inches × 0.1 inch (2.54 cm × 7.63 cm × 0.25 cm) each carrying a centrally disposed longitudinal weld bead.

Since travel speed, voltage and current were recorded, heat inputs for all welded samples are known. In general, good weld penetration was obtained with heat inputs within the range of 7,500 to 11,500 joules per inch (3,000 to 4,528 joules per cm).

4. Testing a. Ductility or Brittleness of As-Welded Samples

Ductility was ascertained using the standard guided bend test apparatus described in the A.S.M.E. Pressure Vessel Code, 1965, Section 9, Page 59, the weldments being tested as-received in unannealed condition, passing being predicated upon the bending of flat samples through an angle of 180° along a line transverse the weld axis without the development of visible cracks. The bend test jig, conforming to the ASME boiler code qualification test for welded samples, had a 200 mil (0.51 cm) radius for the 100 mil (0.254 cm) thick samples, thereby giving a bend radius to sample thickness ratio of 2.

In the Table are recorded the observations of the bend test results. All samples which showed any visible sign of cracking are recorded as having cracked, and are designated by the label C. Those which bent with no sign of cracking are recorded as ductile, designated D.

b. Analyses

Most compositions are reported in the Table on both the As Charged and (at least partially) As Analyzed bases. Carbon was analyzed by a combustion technique in which the evolved $CO_2$ was measured on a gas chromatograph. Nitrogen was analyzed by the micro Kjeldahl and gas fusion methods, in the former of which nitrogen compounds are reduced to ammonia, which is then titrated, whereas in the latter the sample is fused to expel nitrogen, which is then measured by gas chromatography.

c. Intergranular Corrosion Test

Corrosion test coupons were cut from the unbent ends of the welded samples, given an 80grit wet belt finish and then subjected to the corrosion test, ASTM A-262-70, 1971 Book of Standards, Practice B, which consists of immersion in boiling 50% $H_2SO_4$ containing 41.6 grams per liter of ferric sulfate as inhibitor in repeated cycles of 24 hours duration up to a total exposure of 120 hours. Individual samples were rinsed, dried and weighed after each 24 hours of immersion in acid and the corrosion rate determined by calculation from the weight loss.

In addition, the samples, particularly the weld areas, were examined visually and at 40X magnification for signs of corrosion, as evidenced by grain dislodgement or crevicing preceding dislodgement, and specimens were rated as hereinafter described.

d. Interpretation of Corrosion Results

Those samples that showed no attack, or no more than light etching confined to the weld metal or, at worst, a slight crevicing, but only on the weld metal, and that showed a corrosion rate of less than 40 mils per year after 120 hours exposure were considered to pass. Those samples that showed greater weight losses, or that showed moderate or severe attack with grain dropping or dissolution of the weld, were considered to have failed. Comparative test results are best shown in the following Table:

TABLE

| Alloy No. | Composition As Charged Percent by Weight Cr | Nb | Al | Mo | C+N | Composition As Analyzed Percent by Weight Nb | C | N | C+N | Nb C+N (a) | Corrosion, 120 Hrs. | As Welded Ductility After Pre-Anneal At 1650°F | 1750°F |
|---|---|---|---|---|---|---|---|---|---|---|---|---|---|
| 66 | 26 | 0.5 | — | — | 0.08 | | 0.043 | 0.035 | 0.078 | 6.4 | P[b] | D[c] | — |
| 144 | 26 | 0.5 | — | — | 0.08 | | 0.026 | 0.041 | 0.067 | 7.5 | P | C | — |
| 169-1 | 26 | 0.5 | — | — | 0.12 | | 0.041 | 0.068 | 0.109 | 4.6 | — | C | — |
| 169 | 26 | 0.5 | — | — | 0.12 | | 0.046 | 0.059 | 0.105 | 4.8 | F | C | — |
| 260 | 26 | 1.0 | — | — | 0.01 | | 0.006 | 0.007 | 0.013 | 77 | P | C | — |
| 329 | 26 | 1.0 | — | — | 0.08 | | 0.032 | 0.052 | 0.084 | 11.9 | P | C | — |
| 558 | 27 | 0.9 | 0.5 | — | 0.06 | 0.89 | 0.042 | 0.026 | 0.068 | 13.1 | P | D | D |
| 559 | 27 | 0.9 | 0.5 | — | 0.12 | 0.81 | 0.060 | 0.052 | 0.112 | 7.2 | P | C | C |
| 560 | 27 | 0.9 | — | — | 0.12 | 0.85 | 0.065 | 0.070 | 0.135 | 6.3 | F | C | D |
| 561 | 27 | 1.8 | 0.5 | — | 0.06 | | | | | 30 | P | D | D |
| 562 | 27 | 1.8 | — | — | 0.06 | 1.43 | 0.024 | 0.028 | 0.052 | 27.5 | P | C | C |
| 563 | 27 | 1.8 | 0.5 | — | 0.12 | 1.71 | 0.069 | 0.045 | 0.114 | 15.0 | P | D | D |
| 564 | 27 | 1.8 | — | — | 0.12 | 1.72 | 0.064 | 0.058 | 0.122 | 14.1 | P | C | C |
| 565 | 27 | 1.8 | 0.5 | 1.0 | 0.12 | 1.83 | 0.072 | 0.024 | 0.096 | 19.1 | P | D | D |
| 566 | 27 | 0.9 | — | — | 0.06 | 0.88 | 0.033 | 0.027 | 0.060 | 14.7 | P | C | D |
| 567 | 27 | 0.9 | 0.5 | 1.0 | 0.06 | | | | | 15 | P | D | D |
| 575 | 27 | 0.9 | 1.0 | 1.0 | 0.06 | 0.73 | 0.037 | 0.016 | 0.053 | 13.8 | P | D | D |
| 576 | 27 | 0.9 | 0.5 | — | 0.09 | 0.70 | 0.050 | 0.037 | 0.087 | 8.1 | P | C | C |
| 577 | 27 | 0.9 | 0.5 | — | 0.09 | 0.81 | 0.045 | 0.029 | 0.074 | 11.0 | P | C | C |
| 578 | 27 | 0.9 | 0.5 | — | 0.07 | 0.84 | 0.036 | 0.034 | 0.070 | 12.0 | P | D | D |
| Q697 | 26 | 1.0 | — | 1.0 | 0.07 | | 0.055 | 0.008 | 0.063 | 15.9 | P | — | D |
| Q698 | 26 | 1.0 | 0.3 | 1.0 | 0.07 | | 0.059 | 0.005 | 0.064 | 15.6 | P | — | D |

[a]RATIO "AS ANALYZED", EXCEPT WHERE NOT AVAILABLE
[b]P = PASS, F = FAIL
[c]D = DUCTILE, C = CRACKED

5. Experimental Results

Discussion of the Results

Referring to the FIGURE, the experimental results reported in the Table have been plotted for better visualization and appreciation of the invention. The abscissa of the plot is the percent of aluminum in each of the compositions. The ordinate of the plot is the weight ratio of the niobium content to the sum of the contents of C+N (on the "as analyzed" basis, wherever available). The information plotted is the combination of resistance to intergranular attack as well as the ductility after welding. The x's denote samples which failed one or both of the tests: intergranular corrosion resistance and ductility, in the as-welded state, i.e., without any anneal between welding and testing. The circles enclosing a dot are those samples not containing any molybdenum that passed both tests, and the remaining points, marked by circles containing a bar, designate those samples containing 1% Mo which passed. A horizontal dashed line has been drawn in at the ratio 11 of niobium to C+N separating those specimens having a ratio of less than 11 (below the line) from those having a ratio of greater than 11 of niobium to C+ N (above the line). Inspection of the FIGURE and the Table shows that those samples containing less than the ratio 11 generally failed to pass at least one of the tests. Those aluminum-containing samples having more Nb than the ratio 11 passed both tests. The horizontal broken line therefore establishes one boundary of the present invention. The vertical broken line is drawn at the aluminum value of 0.05%. It will be noted that, in all cases except two, samples containing no aluminum failed to pass the tests. All of these samples fall along the ordinate. A single sample (Alloy No. 66 containing no aluminum and no molybdenum) at the ordinate value of 6.5 was both ductile and resistant to intergranular attack, which is in contrast with all the other samples of its type. Another sample (Alloy No. Q697, containing no aluminum but having 1% molybdenum) did pass, but at a niobium to C+N ratio of 15.9. No explanation is available for either of these contradictory results. All of those samples containing more than 0.05% aluminum together with a ratio of niobium to C+N of 11, or greater, passed both the corrosion test and the ductility test. The line 0.05% Al therefore represents another boundary of the invention; namely, that a minimum of 0.05% aluminum is necessary, together with a niobium to C+N ratio in excess of 11.

Molybdenum in the amount of 1% added to the samples conferred improved resistance to other corrosive environments, such as pitting corrosion. Alloys Q697 and Q698 were exposed to tests to determine their pitting corrosion resistance. These tests were carried out by immersing the samples for 696 days in aqueous solutions of 2% potassium permanganate plus 2% sodium chloride at 50°C. Both alloys were resistant to this pitting corrosion test. In addition, these two specimens (and also No. 575) were tested in the stress corrosion test, the Q samples after 2423 hrs. exposure and No. 575 after 1193 hrs. exposure, and there was no cracking.

The stress corrosion test employed is that approved by the American Society for Testing Materials as Standard G36-73, which is performed as follows:

The test solution is boiling (155°C.) 45% $MgCl_2$. The test specimens were 3 inches × ¾ inch wide, 80 mils thick, having a lengthwise autogenous weld, because welded specimens reveal susceptibility to stress corrosion more readily than unwelded specimens. The welded specimens were bent 180° over a 0.366 inch dia. cylindrical mandrel. Stress was applied by tightening a Hastelloy C bolt through holes at each end of the specimen, the bolt being electriclly insulated from the specimen by polytetrafluoroethylene bushings.

Shown in the tabulation is another effect; namely, the temperature at which the post-wrought, prewelding anneal took place seems to affect the ductility of the subsequent as-welded product, at least when the alloy contains no aluminum. It is to be noted particularly that this anneal is after the last step in the forging and rolling of the materials to the desired shape and, thus, prior to any welding operations. In no case was any sample annealed between its welding and its testing, and all of the properties reported are, therefore, on the materials as-welded. The last two columns of the table refer to the observation of as-welded ductility, in the one case when the welding followed an anneal at 1650°F and in the other case when the anneal was carried out at 1750°F. It is seen that two samples, No. 560 and No. 566, which were brittle when the welding followed a 1650°F anneal were ductile when the welding followed an anneal carried out at 1750°F.

Another point deserves particular mention. Lacking knowledge of actual exposure performance, it had been thought that compositions containing as much as 1% aluminum might not be resistant to stress corrosion cracking. This resistance is a property generally of ferritic alloys and is of great value to them. Alloy No. 575 in the tabulation, containing 1% aluminum, was exposed for as long as 1193 hrs. to boiling magnesium chloride in the as-welded condition. As hereinbefore reported, stress corrosion cracking did not occur, indicating that alloys containing as much as 1% aluminum are resistant to cracking under this very severe test.

What is claimed is:

1. A ferritic alloy having good as-welded ductility in that it passes the standard guided bend test prescribed by the A.S.M.E. Pressure Vessel Code, 1965, Section 9, Page 59 using a bend test jig having a bend radius to sample thickness ratio of 2 without visible cracking, and good corrosion resistance in that it passes the ASTM A-262-70, 1971 Book of Standards, Practice B test consisting of immersion in boiling 50% $H_2SO_4$ containing 41.6 gm./liter of ferric sulfate as inhibitor in repeated cycles of 24 hours duration each up to a total exposure of 120 hours, after which the specimens tested exhibited a corrosion rate of less than 40 mils ($10.16 \times 10^{-2}$ cm) per year, consisting essentially of the following percentages by weight:

| | |
|---|---|
| chromium | 25–28 |
| molybdenum | 0–1.5 |
| aluminum | 0.05–1.0 |
| carbon + nitrogen | 0.18 max. |
| niobium | 2% max. but at least 11 times the C+N content, |

the balance being iron and incidental impurities.

2. A ferritic alloy having good as-welded ductility and corrosion resistance according to claim 1 consisting essentially of the following percentages by weight:

| | |
|---|---|
| chromium | 26–27 |
| molybdenum | 0.5–1.5 |
| aluminum | 0.05–1.0 |
| carbon + nitrogen | 0.15 max. |
| niobium | 2.0% max. but at least 11 times the C+N content, |

the balance being iron and incidental impurities.

3. A ferritic alloy having good as-welded ductility and corrosion resistance according to claim 1 consisting essentially of the following percentages by weight:

| | |
|---|---|
| chromium | 26–27 |
| molybdenum | 0.5–1.5 |
| aluminum | 0.1–0.8 |
| carbon + nitrogen | 0.15 max. |
| niobium | 2.0% max. but at least 11 times the C+N content, |

the balance being iron and incidental impurities.

4. A welded article fabricated from the alloy of claim 1.

* * * * *

UNITED STATES PATENT OFFICE

CERTIFICATE OF CORRECTION

Patent No. 3,963,532 Dated June 15, 1976

Inventor(s) Joseph J. Demo, Jr.

It is certified that error appears in the above-identified patent and that said Letters Patent are hereby corrected as shown below:

Column 1, line 17, "0.1" should read -- 1.0 --.

Column 1, line 33, "steel" should read -- steels--.

Column 1, line 38, "bee" should read -- been --.

Column 1, line 42, "thre" should read -- there --.

Signed and Sealed this

Second Day of November 1976

[SEAL]

*Attest:*

RUTH C. MASON
*Attesting Officer*

C. MARSHALL DANN
*Commissioner of Patents and Trademarks*